US006334540B1

(12) United States Patent
Plutsky

(10) Patent No.: US 6,334,540 B1
(45) Date of Patent: Jan. 1, 2002

(54) DISPLAY RACK WITH SLIDABLE MEMBER

(75) Inventor: Sheldon Plutsky, Chatsworth, CA (US)

(73) Assignee: Pioneers Photo Albums, Inc., Chatsworth, CA (US)

( * ) Notice: Subject to any disclaimer, the term of this patent is extended or adjusted under 35 U.S.C. 154(b) by 0 days.

(21) Appl. No.: 09/564,251

(22) Filed: May 4, 2000

Related U.S. Application Data

(60) Provisional application No. 60/154,907, filed on Sep. 21, 1999.

(51) Int. Cl.[7] ..... A47B 65/00

(52) U.S. Cl. ..... 211/43; 211/57.1; 211/59.1

(58) Field of Search ..... 211/43, 184, 54.1, 211/51, 87.01, 59.1, 59.4, 7, 183; 248/220.31, 220.41, 220.42, 220.43, 221.11, 222.51

(56) References Cited

U.S. PATENT DOCUMENTS

| | | | | | |
|---|---|---|---|---|---|
| 518,573 | A | | 4/1894 | Parker | |
| 1,416,969 | A | | 5/1922 | O'Connor | |
| 1,660,823 | A | | 2/1928 | Thometz | |
| 2,912,151 | A | | 11/1959 | Crabs | 224/50 |
| 3,171,542 | A | | 3/1965 | Jacobs et al. | 211/43 |
| 3,173,708 | A | | 3/1965 | Machielse et al. | 280/179 |
| 3,534,864 | A | * | 10/1970 | Larson | 211/57.1 |
| 3,638,801 | A | * | 2/1972 | Larson | 211/57.1 |
| 3,780,873 | A | | 12/1973 | Silva | 211/49 |
| 4,023,682 | A | | 5/1977 | Niece | 211/184 |
| 4,066,169 | A | * | 1/1978 | Hochman | 211/57.1 |
| 4,289,242 | A | * | 9/1981 | Kenyon | 211/59.1 |
| 4,474,300 | A | * | 10/1984 | Entis | 211/57.1 |
| 4,600,110 | A | * | 7/1986 | Timor | 211/184 |
| 4,606,464 | A | * | 8/1986 | Jordan et al. | 211/184 |
| 4,762,299 | A | * | 8/1988 | Langelier | 248/220.4 |
| 4,813,535 | A | * | 3/1989 | Radocha et al. | 248/220.4 |
| 4,821,894 | A | * | 4/1989 | Dechirot | 211/59.3 |
| 5,082,125 | A | * | 1/1992 | Ninni | 211/184 |
| 5,088,606 | A | * | 2/1992 | Boas | 211/57.1 |
| 5,114,021 | A | * | 5/1992 | Frederickson | 211/54.1 |
| 5,222,608 | A | * | 6/1993 | Eklof et al. | 211/54.1 |
| 5,257,702 | A | | 11/1993 | Grafstein | 211/106 |
| 5,411,146 | A | | 5/1995 | Jarecki et al. | 211/59 |
| 5,415,297 | A | | 5/1995 | Klein et al. | 211/40 |
| 5,485,929 | A | * | 1/1996 | Danon | 211/57.1 |
| 5,505,315 | A | | 4/1996 | Carroll | 211/59.2 |
| 5,664,690 | A | * | 9/1997 | Friesen | 248/220.41 |
| 5,671,851 | A | * | 9/1997 | Johnson et al. | 211/51 |
| 5,855,282 | A | * | 1/1999 | Hardy | 211/59.1 |
| 6,003,685 | A | * | 12/1999 | Malin | 211/59.1 |
| 6,158,598 | A | * | 12/2000 | Josefsson | 211/54.1 |

* cited by examiner

*Primary Examiner*—Jerry Redman
*Assistant Examiner*—Jennifer E. Novosad
(74) *Attorney, Agent, or Firm*—Jeffer, Mangels, Butler & Marmaro, LLP

(57) ABSTRACT

A display rack including a pair of substantially horizontally oriented members in substantially parallel spaced relation, a stop member associated with said first ends of said pair of substantially horizontally oriented members, a securing portion affixed to said second ends of said pair of substantially horizontally oriented members, and a carriage. The substantially horizontally oriented members each have first and second ends, the second ends of which are turned upwardly. The securing portion has at least one peg hook extending upwardly and rearwardly therefrom. The carriage includes a middle portion extending between and above the pair of substantially horizontally oriented members and a pair of engagement members that slidingly engage the pair of substantially horizontally oriented members.

28 Claims, 8 Drawing Sheets

10
20
22
24
26
28
28a
30
32
34
36
38
40
42
44
46
48
50
52
54
56
58
60
62
64
66
68
70
72
74
76
78
80
82
84
86
88
90
92
94
96
98
100
102
104
106
108

DISPLAY RACK WITH SLIDABLE MEMBER

RELATED APPLICATIONS

This application claims priority from provisional patent application Ser. No. 60/154,907 entitled "Photo Album Bracket" filed Sep. 21, 1999.

FIELD OF THE INVENTION

The present invention relates to a rack for displaying objects, and more particularly to a rack for displaying objects having a slidable member for holding the objects in place.

BACKGROUND OF THE INVENTION

Retail stores have a limited amount of space in which to display products or present them for sale. Many products are presented for sale by placing them on shelves, racks or the like. Racks having parallel rods that extend outwardly from a slatwall, pegboard or the like are known. These racks are used for selling items, such as photo albums, by placing a stack of items back to front in a vertical orientation on the parallel rods. However, as consumers take the items off the rack, and the number of items on the rack decreases, the items tend to slip and are not as presentable as when in a vertical orientation.

It is desirable to include a slidable member on the rack that holds the items in place. Devices that include parallel rods having slidable members thereon are known. For example, U.S. Pat. No. 518,573 to Parker teaches a book rack having slidable dividers thereon for holding books in an upright position. U.S. Pat. No. 2,912,151 to Crabs teaches a mail carrier that includes two parallel rods, a ridable member and a strap for securing the mail thereon. U.S. Pat. No. 3,780,873 to Silva teaches a display rack for displaying packages. However, none of these racks are intended to be secured to a slatwall, pegboard or the like.

A long felt need exists for a rack that can be secured to a slatwall, pegboard or the like, wherein salable product can be displayed wherein as product is removed the remaining items are held in a vertical orientation for presentation to consumers.

SUMMARY OF THE PREFERRED EMBODIMENTS

In accordance with one aspect of the present invention there is provided a method of displaying products that includes the steps of providing a display rack, securing the display rack to a substantially vertically oriented surface, placing at least one of the products on said display rack, and contacting a slidable carriage with the at least one product. In a preferred embodiment, the display rack includes a substantially horizontally oriented portion that forms a non-right angle with the substantially vertically oriented surface.

In accordance with another aspect of the present invention there is provided a display rack that includes a substantially horizontally oriented member having first and second opposite ends, a securing portion affixed to the second end of the substantially horizontally oriented member, and a carriage slidably engaged with the substantially horizontally oriented member. The securing portion including means for removably securing the rack to a substantially vertically oriented surface. In a preferred embodiment the means for removably securing the rack to a substantially vertically oriented surface comprises at least one peg hook. In other preferred embodiments, the substantially horizontally oriented member forms a non-right angle θ with the substantially vertically oriented surface, when removably secured thereto and at least a portion of the carriage extends above the substantially horizontally oriented member.

In accordance with yet another aspect of the present invention there is provided a display rack including a pair of substantially horizontally oriented members in substantially parallel spaced relation, a stop member associated with said first ends of said pair of substantially horizontally oriented members, a securing portion affixed to said second ends of said pair of substantially horizontally oriented members, and a carriage. The substantially horizontally oriented members each have first and second ends, the second ends of which are turned upwardly. The securing portion has at least one peg hook extending upwardly and rearwardly therefrom. The carriage includes a middle portion extending between and above the pair of substantially horizontally oriented members and a pair of engagement members that slidingly engage the pair of substantially horizontally oriented members.

Other objects, features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

With reference generally to FIGS. 1–6, a first embodiment of a display rack 10 is shown. The rack 10 generally includes a substantially horizontally oriented portion, that includes first and second elongated members 12,14; a carriage 16; and a securing portion 18. It will be appreciated that terms such as "vertically," "horizontally," "upper," "top" and "downwardly" used hereinbelow are used merely for ease of description and refer to the orientation of the components as shown in the Figures. It should be understood that any orientation of the display rack described herein is within the scope of the present invention.

Figure 1:
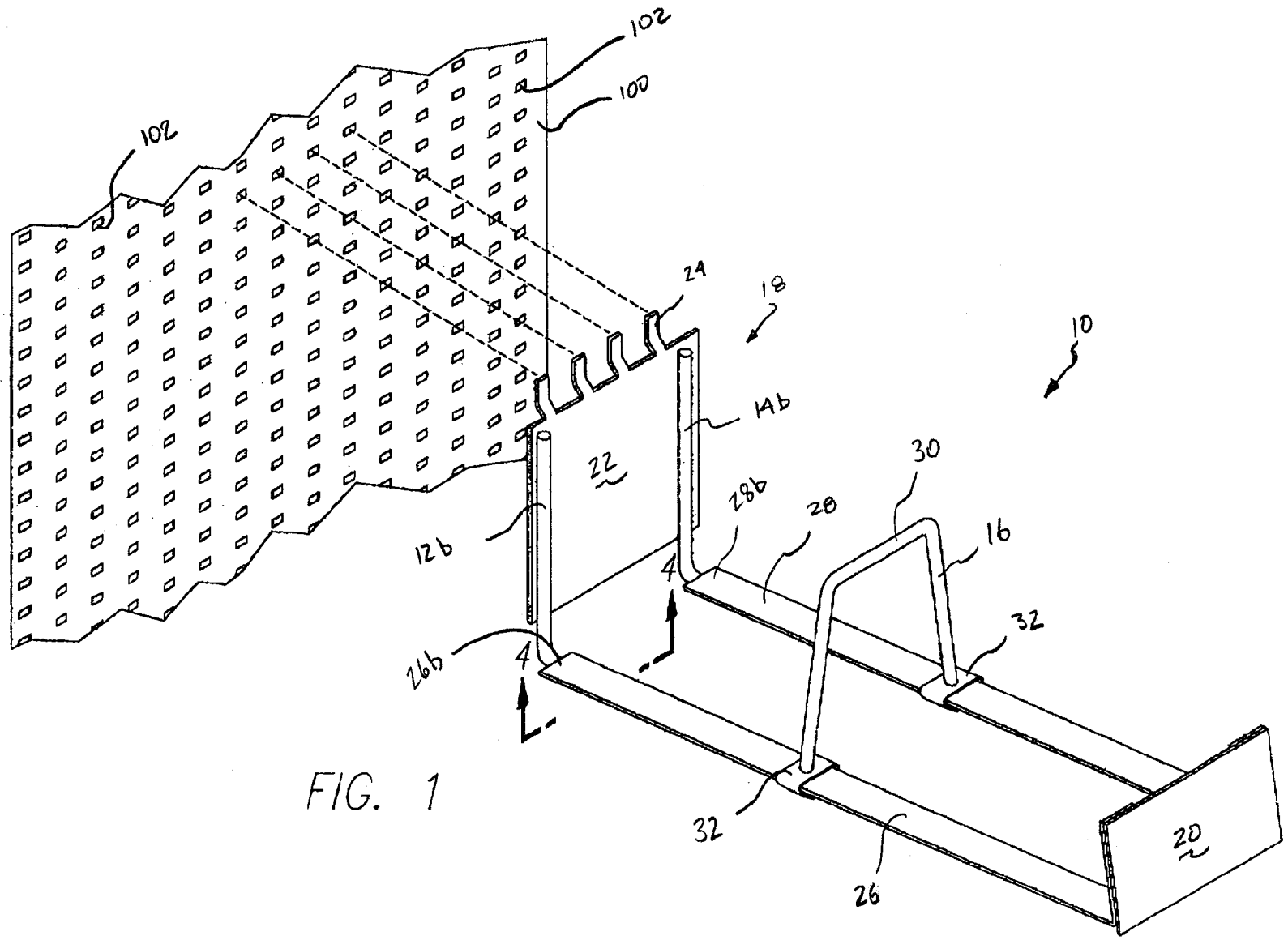
FIG. 1 is a perspective view of a display rack and a peg board in accordance with a first embodiment of the present invention.
Figure 3:
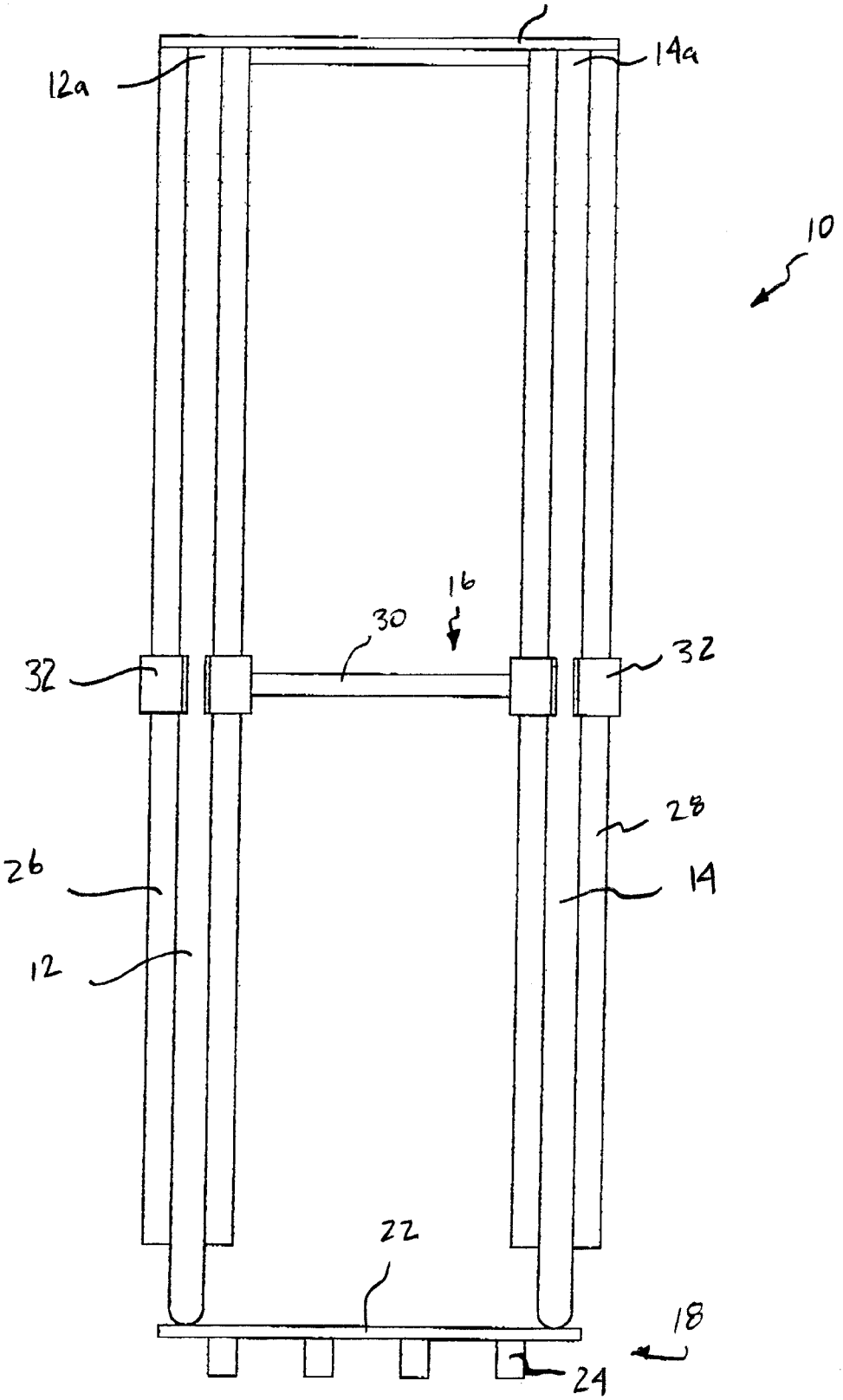
FIG. 3 is a bottom elevation of the display rack of FIG. 1.

Preferably, first and second elongated members 12, 14 are in substantially parallel spaced relation (as best shown in FIG. 3). Secured to a first end 12*a*, 14*a* of the first and second elongated members 12,14 is a stop member 20, and secured at the second end 12*b*, 14*b* (opposite end) is the securing portion 18. As shown in FIG. 1, the securing portion 18 preferably includes a plate 22 having means for removably securing the display rack to a merchandising display panel (described below). The means for removably securing the display rack to a merchandising display panel can include hooks, clamps, pegs, magnets, adhesive or any other means for securing known in the art. Preferably, the plate 22 includes peg hooks 24 extending upwardly and rearwardly therefrom. The securing portion 18 can also include the second ends 12*b*,14*b* of the first and second elongated members 12,14 being connected and having peg hooks or the like extending therefrom.

Figure 2:
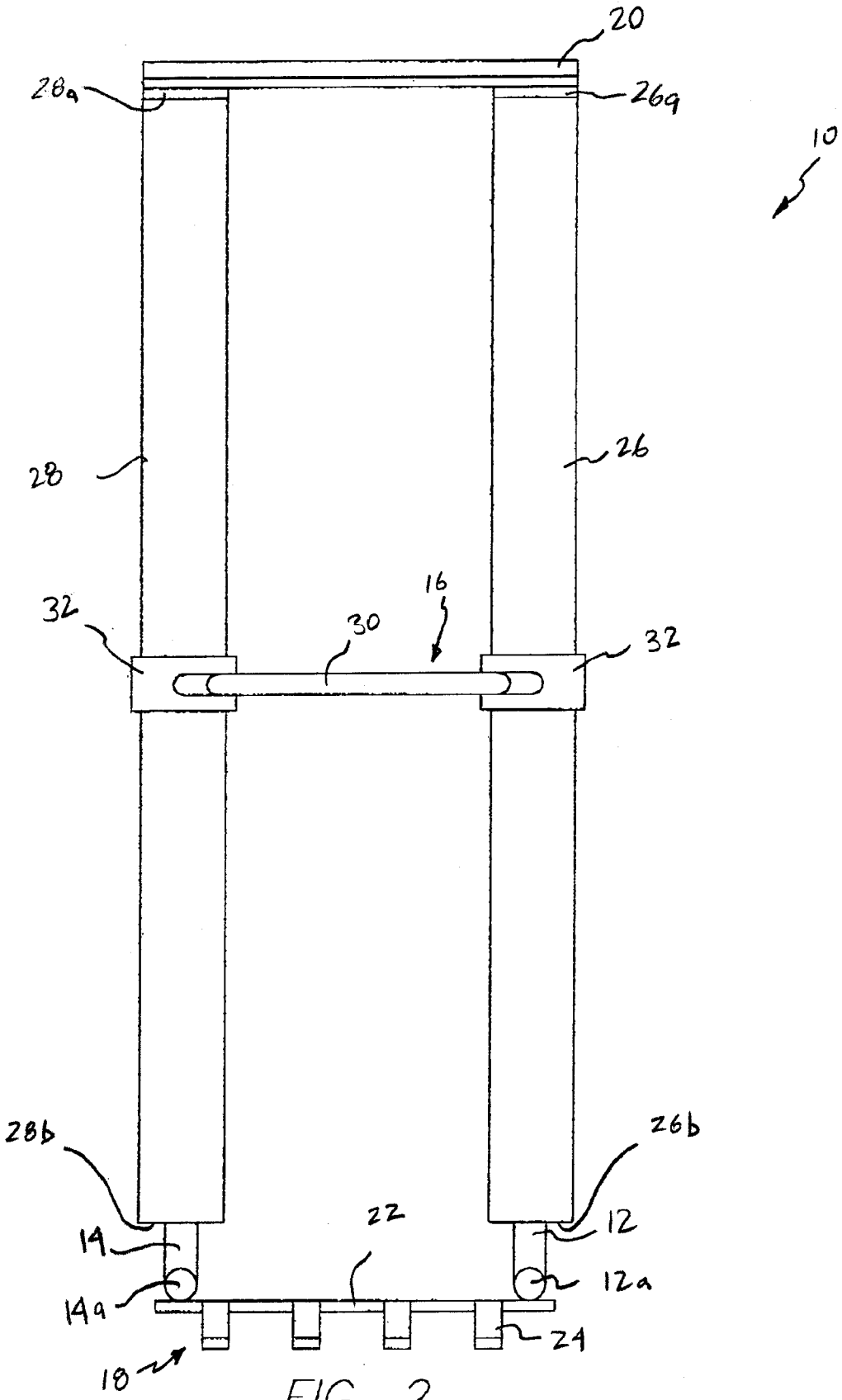
FIG. 2 is a top elevation of the display rack of FIG. 1.

In a preferred embodiment, as shown in FIGS. 1 and 2, the second ends 12*b*, 14*b* of the first and second elongated members 12,14 are turned upwardly, and the securing portion 18 is secured thereto by welding, adhering or other known securing method. In an alternative embodiment the second ends 12*b*, 14*b* of the first and second elongated members 12,14 are not turned up, and the securing portion is secured to the ends or a top surface thereof The elements of the securing portion 18 (the plate 22, and the peg hooks 24) can be formed as a unit, or the peg hooks 24 can be affixed to the plate 22. In a preferred embodiment the securing portion 18 includes four peg hooks 24, however, any number of peg hooks is within the scope of the present invention.

Figure 4:
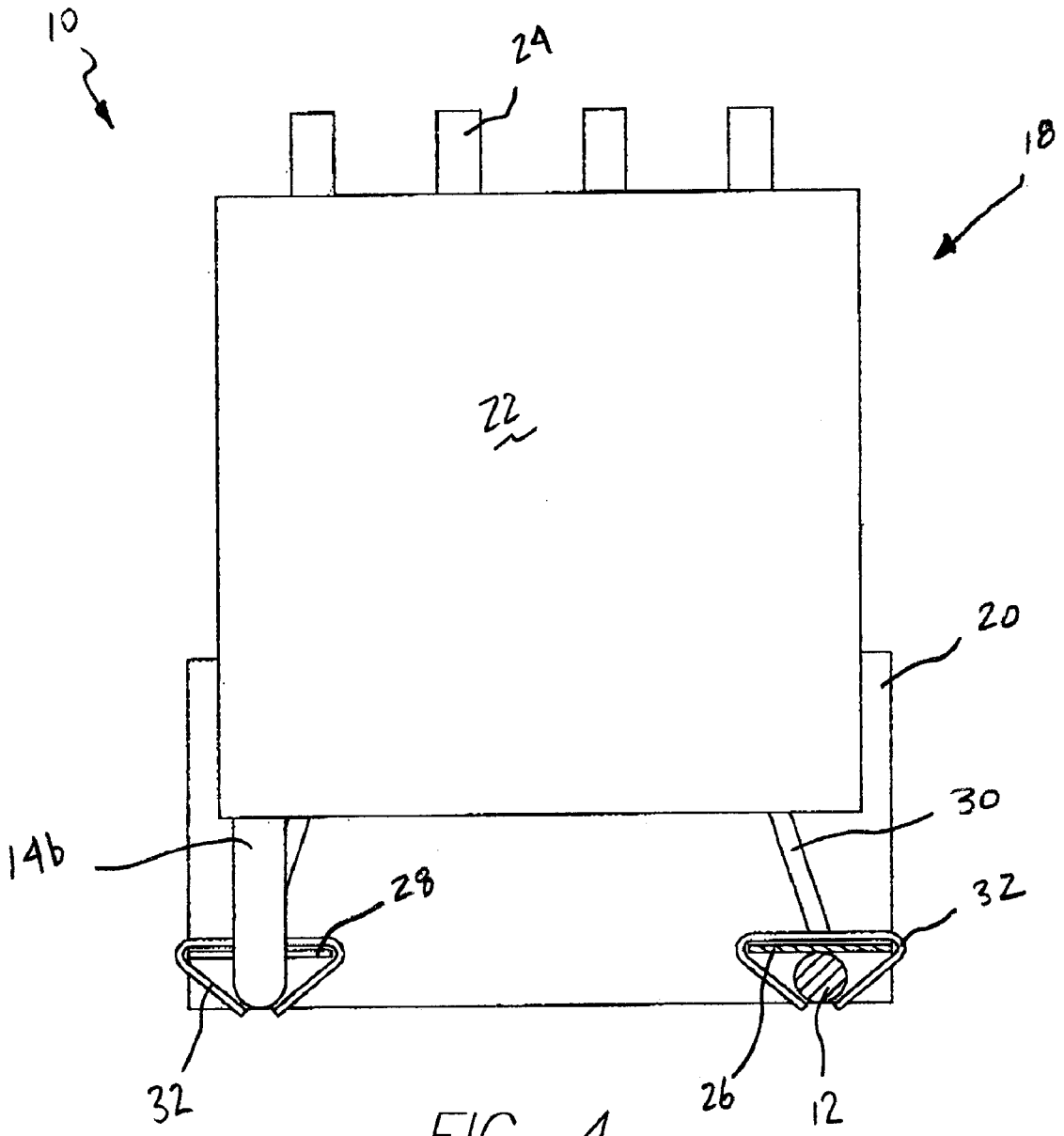
FIG. 4 is a rear elevation of the display rack of FIG. 1 with a portion of the display rack in section taken along line 4—4 of FIG. 1.
Figure 5:
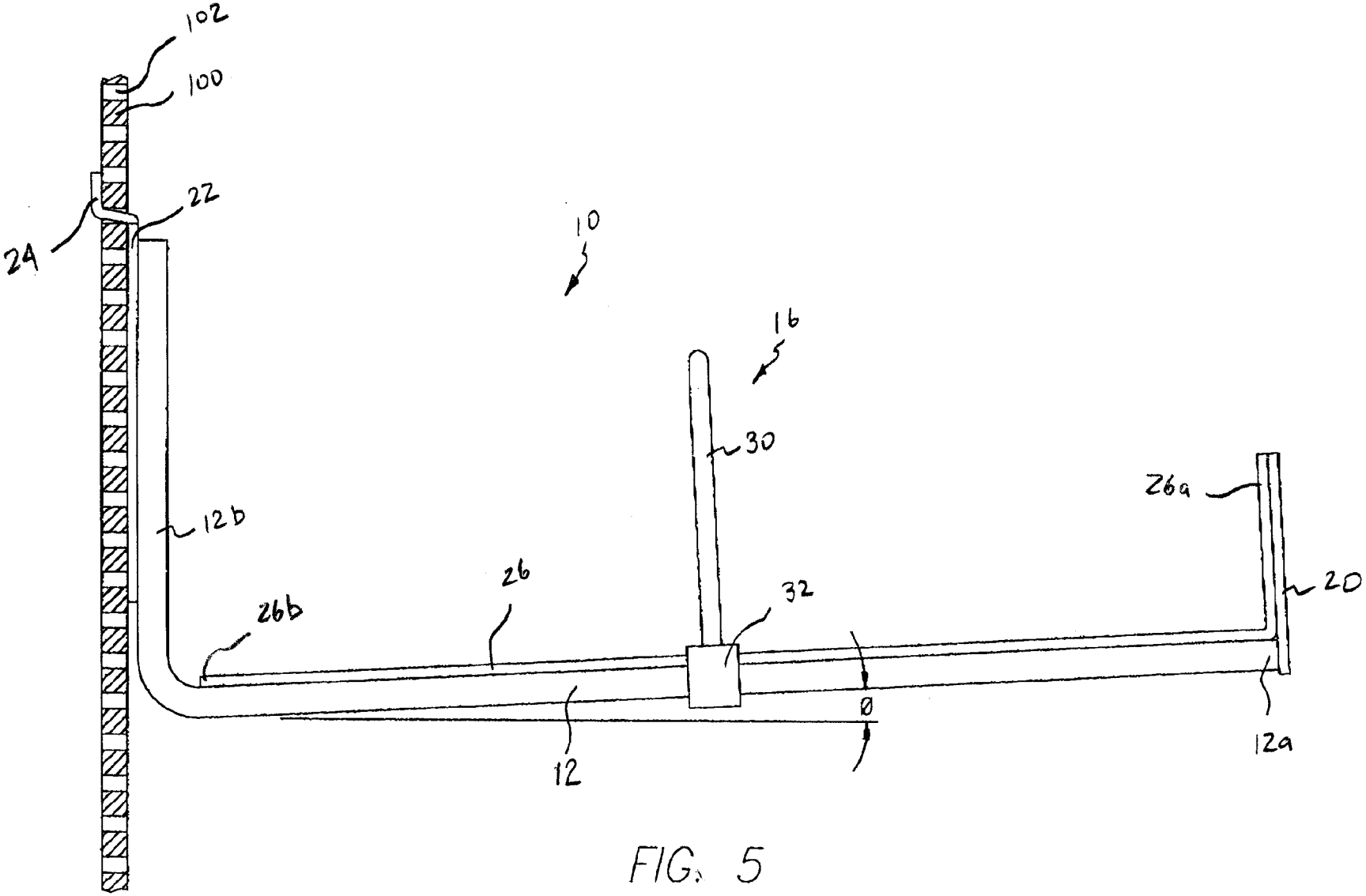
FIG. 5 is a side elevation of the display rack of FIG. 1 showing the angle θ.

As shown in FIG. 4, the first and second elongated members 12,14 preferably have a round transverse cross-section. However, they can be any geometric shape, such as square, rectangular, etc. In a preferred embodiment, the first and second elongated members 12,14 include elongated flat members 26,28 affixed to a top surface thereof. The elongated flat members 26,28 have first and second opposite ends 26*a*,28*a*,26*b*,28*b*, the first ends of which are preferably turned up and have the stop member 20 affixed thereto. As with the securing portion 18, the stop member 20 can also be affixed to the ends or top surface of the first and second elongated members 12,14 or the elongated flat members 26,28. The securing portion 18 and the stop member 20 are therefore located adjacent opposite ends of the first and second elongated members 12,14 and the elongated flat members 26,28 and are substantially vertically oriented.

Figure 6:
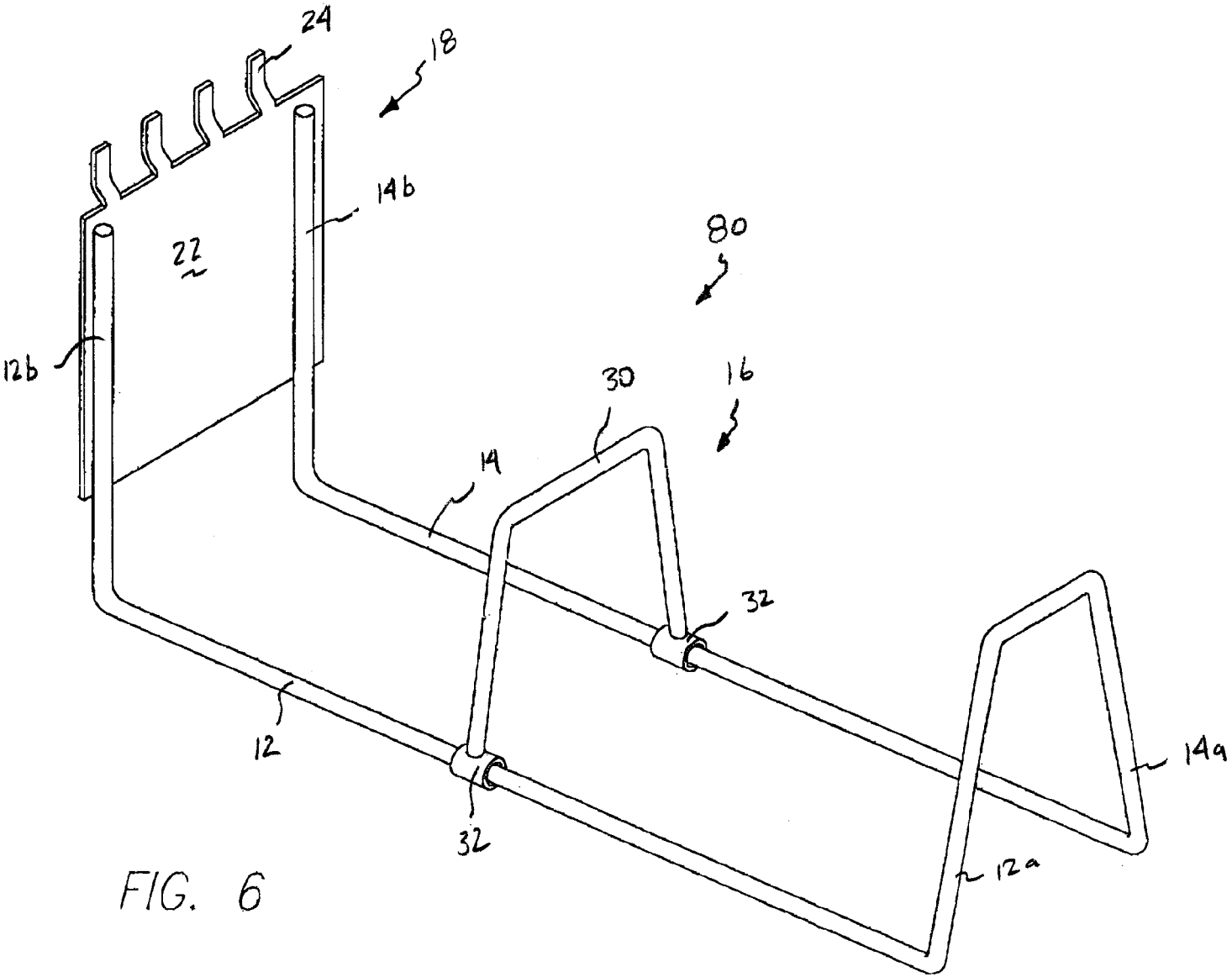
FIG. 6 is a perspective view of a display rack and a peg board in accordance with a second embodiment of the present invention.

Preferably, the carriage 16 includes a middle portion 30 and two engagement members 32. The engagement members 32 slidably engage the first and second elongated members 12,14 and the elongated flat members 26,28 as shown in FIG. 3. The middle portion 30 extends above the first and second elongated members 12,14. As shown in FIG. 6, in a second embodiment, the elongated flat members 26,28 may be omitted and the engagement members 32 may slidably engage the first and second elongated members alone. In this embodiment, stop member 20 is comprised of the first ends 12*a*,14*a* of the first and second elongated members 12,14, which are turned upwardly and inwardly to form a unitary piece (see FIG. 6). Furthermore, in this embodiment, the engagement members 32 are tubular in shape for engagement with the round first and second elongated members 12,14.

The components of the display rack 10 are comprised of a rigid material such as steel or other metal, a strong plastic or the like. The elements of the display rack 10 can be formed as a unit, or the separate elements can be formed as separate pieces and affixed to one another.

The display rack 10 is intended to be used with a merchandise display panel or similar display. The display can be a pegboard or other perforated board, a wire grid merchandising panel, a slatwall merchandising panel or any other display panel known in the merchandising art. As described herein, the display rack 10 is used to display photo albums 110, and is removably secured to a pegboard 100 that includes a plurality of apertures 102 defined therein, however, it will be understood that this is not a limitation on the present invention.

Figure 7:
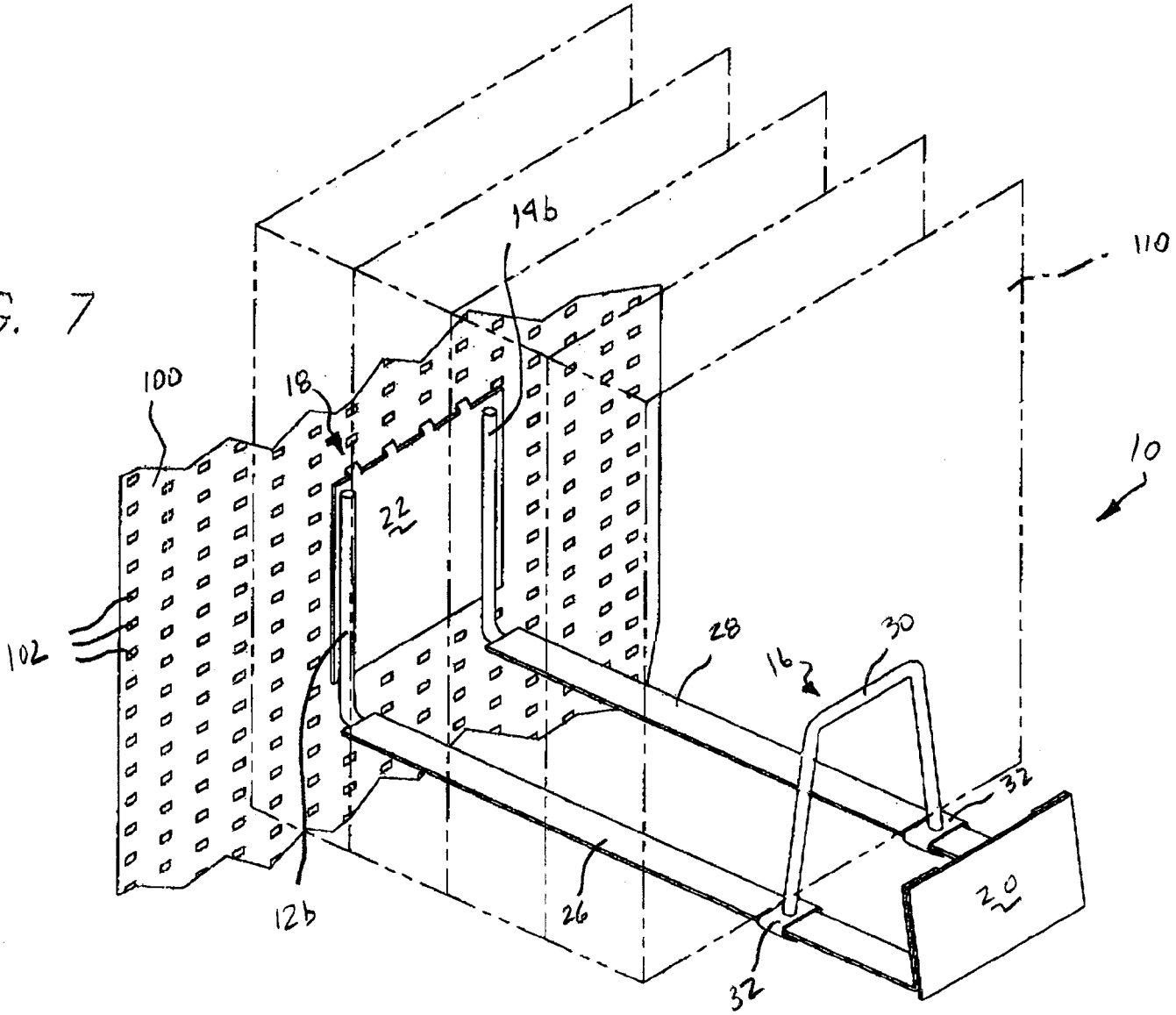
FIG. 7 is a perspective view of a display rack removably secured to a peg board and having photo albums displayed thereon.
Figure 8:
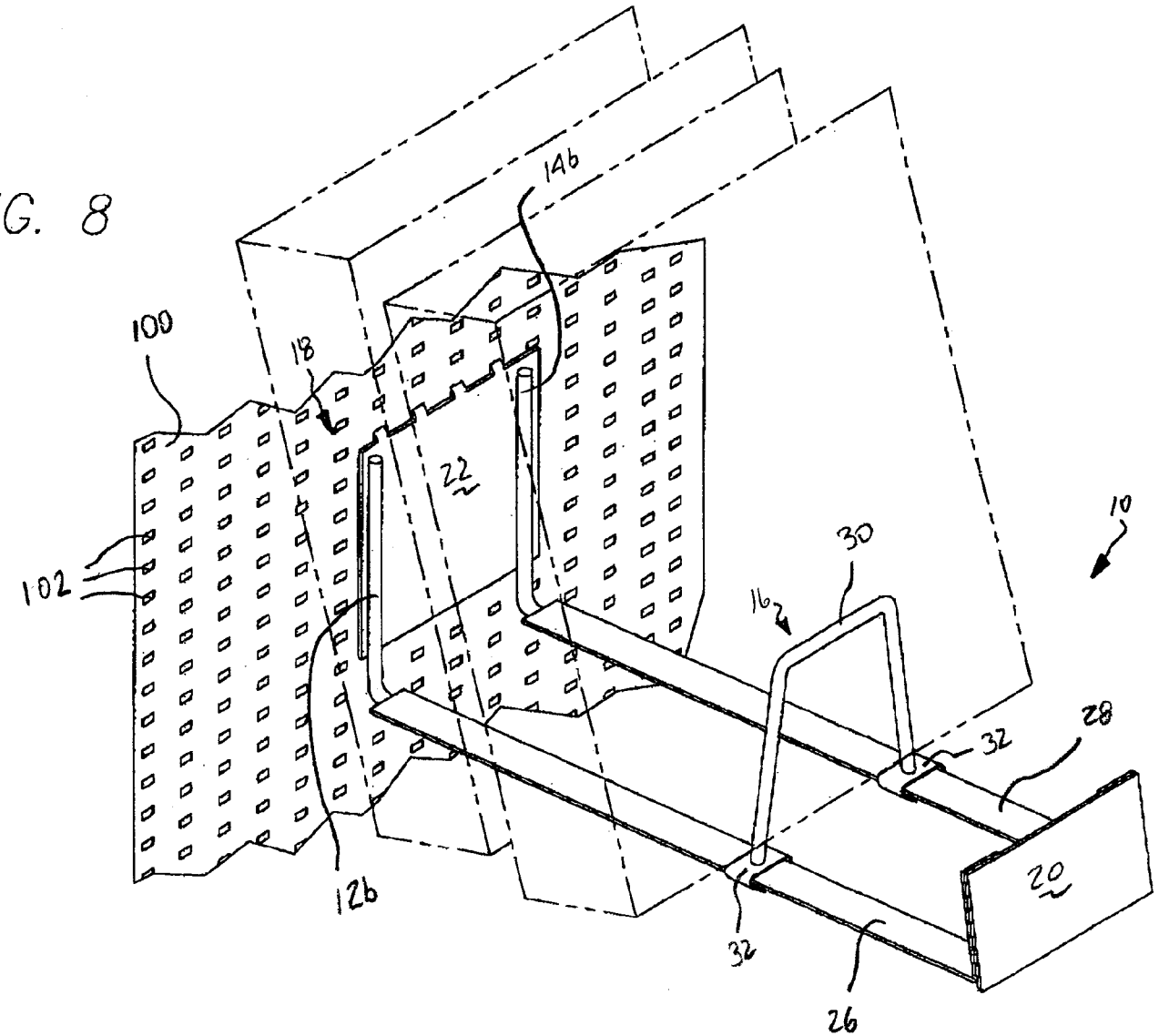
FIG. 8 is a perspective view of a display rack removably secured to a peg board and having photo albums displayed thereon) where one of the photo albums has begun to slip and is stopped by the carriage.

Referring to FIGS. 7–8, in operation, the peg hooks 24 are received in some of the apertures 102 in the pegboard 100 (or the slots in a slatwall, or the openings in a wire grid merchandising panel). The plate 22 of the securing portion 18 contacts the peg board 100 causing the first and second elongated members 12,14 to extend outwardly from the pegboard 100. Preferably, the display rack 10 is fabricated such that the first and second elongated members 12,14 (and the entire substantially horizontally oriented portion) form an angle θ (as shown in FIG. 7) with a plane normal to the pegboard 100 (and the plate 22). In other words, the substantially horizontally oriented portion forms a non-right angle with the pegboard. In a preferred embodiment, θ is between 1° and 20°. In a more preferred embodiment, θ is between 3° and 10°. Any value for θ is within the scope of the present invention.

The photo albums 110 are placed on the elongated flat members 26,28, between the securing portion 18 and the carriage 16, as shown in FIG. 7 (or on the first and second elongated members 12,14 directly, as in the embodiment 80 shown in FIG. 6).

Preferably, the engagement members 32 are fit onto the first and second elongated members and/or elongated flat members 26,28 such that there is enough "play" that when the forwardmost photo album 110 begins to slide, the engagement members 32 lock against the first and second elongated members and/or elongated flat members 26,28, thus preventing the photo album 110 from slipping any further as shown in FIG. 8

It will be understood that the display rack generally includes a portion for securing the rack to a merchandising display panel, an elongated substantially horizontally portion for supporting salable product and a carriage slidably engaged with the elongated substantially horizontally portion. The embodiments of the present invention recited herein are intended to be merely exemplary and those skilled in the art will be able to make numerous modifications to them without departing from the spirit of the present invention. For example, the rack 10 can include more than two horizontal members or more than one carriage; the horizontal portion can be a single flat piece that is engaged by the carriage, instead of multiple parallel members; the stop portion 20 can be omitted; the elongated flat members can be omitted; the display rack can include rails or side walls for holding the items in place; the display rack can be permanently affixed to the wall, pegboard or other vertically oriented surface; the peg hooks 24 can be a single long piece for engaging a slatwall or the carriage 16 can include a spring or other resilient member that biases it against the salable products. All such modifications are intended to be within the scope of the present invention as defined by the claims appended hereto.

What is claimed is:

1. A display rack for products comprising:

(a) a substantially horizontally oriented member having first and second opposite ends, (b) a securing portion associated with said second end of said substantially horizontally oriented member, said securing portion including means for removably securing said rack to a substantially vertically oriented surface, and (c) an unbiased carriage slidably engaged with said substantially horizontally oriented member, the carriage comprising an upwardly oriented member which in use is disengaged from the products.

2. The display rack of claim 1, wherein said means for removably securing said rack to a substantially vertically oriented surface comprises at least one peg hook.

3. The display rack of claim 1, wherein said substantially horizontally oriented member forms a non-right angle (θ) with said substantially vertically oriented surface, when removably secured thereto.

4. The display rack of claim 3, wherein said angle (θ) is between 1° and 20°.

5. The display rack of claim 3, wherein said angle (θ) is between 3° and 10°.

6. The display rack of claim 1 wherein said substantially horizontally oriented member comprises first and second elongated members that are spaced apart and substantially parallel.

7. The display rack of claim 6 wherein said carriage comprises a pair of engagement members for slidably engaging said first and second elongated members.

8. The display rack of claim 7 wherein said first and second elongated members include first and second ends, and wherein said second ends of said first and second elongated members extend upwardly and have said securing portion affixed thereto.

9. The display rack of claim 6 wherein said substantially horizontally oriented member further comprises a pair of elongated flat members affixed to an upper surface of said first and second elongated members.

10. The display rack of claim 1 wherein said securing portion comprises a plate, and said means for removably securing said rack to a substantially vertically oriented surface comprises a plurality of peg hooks extending upwardly and rearwardly therefrom.

11. The display rack of claim 1 wherein at least a portion of said carriage extends above said substantially horizontally oriented member.

12. The display rack of claim 1 further comprising a stop portion associated with said first end of said substantially horizontally oriented member.

13. A method of displaying products, the method comprising the steps of:

(a) providing a display rack having an upper surface;

(b) providing an unbiased carriage, the carriage being adapted to move along the upper surface of the display rack;

(c) providing a plurality of products; and (d) resting the products on the upper surface of the display rack.

14. The method of claim 13 wherein as products are removed from the display rack, the carriage is manually moved.

15. A display assembly for products, the display assembly comprising:

(a) a display rack having an upper surface, the display rack having opposed ends, one of said ends having peg hooks associated therewith, the other of said ends having an upwardly extending fixed stop member;

(b) a carriage adapted to move along the upper surface of the display rack; and (c) a plurality of products, substantially the entire product resting upon the upper surface of the display rack.

16. The display assembly according to claim 15 wherein the peg hooks extend from a plate which is attached to the display rack.

17. The display assembly according to claim 15 wherein the carriage is unbiased along the upper surface of the display rack.

18. The display assembly according to claim 15, wherein the stop member is a plate.

19. The display assembly according to claim 15 wherein the stop member is tubular.

20. The display assembly according to claim 15 wherein the display rack is formed of generally parallel elongated members.

21. The display assembly according to claim 15, wherein the products and the stop member each have a major generally planar surface, and wherein the planar surface of the products and the stop member are upwardly oriented in substantially the same direction.

22. A display rack for supporting photo albums, the display rack comprising:

(a) an elongated upper surface for supporting the albums, the upper surface having opposed ends, one of the ends having a stop member affixed thereto, and the other one of the ends having peg hooks associated therewith;

(b) a movable carriage adapted to slide along the upper surface, the carriage having an elongated member having two ends, each end having an engagement member movably engaged with the elongated surface, (c) wherein the peg hooks, elongated member and stop member, each extend upwardly from the upper surface in generally substantially the same direction.

23. The display rack according to claim 22, wherein the upper surface is generally planar.

24. The display rack according to claim 22, wherein the carriage is unbiased along the upper surface.

25. A display rack for products comprising:

(a) a substantially horizontally oriented member having first and second opposite ends, the substantially horizontally oriented member having a generally planar upper surface, (b) a securing portion associated with said second end of said substantially horizontally oriented member, said securing portion including means for removably securing said rack to a substantially vertically oriented surface, and (c) a carriage slidably engaged with said substantially horizontally oriented member, wherein the carriage includes at least two engagement members, each engagement member comprising a generally triangularly shaped cross section.

26. The display rack of claim 25, wherein the carriage is unbiased along the substantially horizontally oriented member.

27. The display rack of claim 25, wherein the substantially horizontally oriented member comprises a first elongated member having a generally round cross section and a second elongated member having a planar surface.

28. The display rack of claim 27, wherein the carriage includes an engagement member adapted to engage the substantially horizontally oriented member about the first and second elongated members.

* * * * *

UNITED STATES PATENT AND TRADEMARK OFFICE

CERTIFICATE OF CORRECTION

PATENT NO. : 6,334,540 B1
DATED : January 1, 2002
INVENTOR(S) : Sheldon Plusky

It is certified that error appears in the above-identified patent and that said Letters Patent is hereby corrected as shown below:

Title page,
Assignee: Pioneer Photo Albums, Inc.

Signed and Sealed this

Sixteenth Day of April, 2002

*Attest:*

*Attesting Officer*

JAMES E. ROGAN
*Director of the United States Patent and Trademark Office*